United States Patent [19]

Albert

[11] Patent Number: 4,478,448

[45] Date of Patent: Oct. 23, 1984

[54] ANIMAL EXCREMENT REMOVAL DEVICE

[76] Inventor: Karmen D. Albert, 74-16 58th Ave., Elmhurst, N.Y. 11373

[21] Appl. No.: 385,812

[22] Filed: Jun. 7, 1982

[51] Int. Cl.[3] ..... A01K 29/00; A47L 5/04

[52] U.S. Cl. ..... 294/1 BA; 15/341; 294/55

[58] Field of Search ..... 294/1 B, 1 BA, 1 BB, 294/55, 64 R; 15/257.1–257.7, 341, 344, 347

[56] References Cited

U.S. PATENT DOCUMENTS

| | | | |
|---|---|---|---|
| 1,029,916 | 6/1912 | De Mattia | 15/341 |
| 1,095,236 | 5/1914 | Schirra | 15/341 X |
| 1,105,942 | 8/1914 | Waring | 15/341 X |
| 1,146,540 | 7/1915 | Winter | 15/341 X |
| 1,748,336 | 2/1930 | Finnell | 15/257.4 X |
| 2,473,066 | 6/1949 | Miller | 15/344 X |
| 2,823,470 | 2/1958 | Page | 294/55 X |
| 3,484,033 | 12/1969 | Sachs | 15/341 X |
| 3,543,990 | 12/1970 | Fortune | 15/341 X |
| 3,910,619 | 10/1975 | Schmieler | 294/1 BA |
| 4,154,389 | 5/1979 | Dell'Anno | 294/1 B |

FOREIGN PATENT DOCUMENTS

| | | | |
|---|---|---|---|
| 508621 | 7/1939 | United Kingdom | 15/341 |

*Primary Examiner*—Johnny D. Cherry
*Attorney, Agent, or Firm*—Peter K. Kontler

[57] ABSTRACT

An animal excrement removal device is provided which includes an excrement containing housing adapted to receive and retain the excrement; a piston adapted to generate sufficient suction to draw the excrement into the housing; a priming device adapted to actuate the piston; and a trigger adapted to release the piston from its actuated position and generate sufficient suction in the housing in order to draw the excrement therein. The housing may be baffled to prevent the excrement from being drawn up into the piston. Alternatively, a disposable bag may be utilized within the housing to assist the owner in readily disposing of the excrement. The priming device may be mechanically or electrically assisted.

8 Claims, 11 Drawing Figures

ANIMAL EXCREMENT REMOVAL DEVICE

BACKGROUND OF THE INVENTION

The present invention relates generally to an animal excrement removal device and, more particularly, to a hand held or portable animal excrement removal device which may be used by an individual when walking his or her animal. The device of the present invention includes an excrement containing housing including in one embodiment a disposable bag adapted to receive and retain the excrement and then permit ready disposal of it without the individual having to handle or otherwise contact the excrement. It further includes piston means adapted to generate sufficient suction in the excrement containing housing so as to draw the excrement therein. Priming means are further provided for actuating the piston means and release means are included to release the piston means from its actuated position and thus generate suction in the housing.

It will be appreciated that in an urban environment animal excrement has become an increasingly serious problem and a number of municipalities have enacted "curb your dog" ordinances not only requiring that animals be walked on leashes in the streets but that their owners assume responsibility for removal of their animal's excrement from the street. For example, New York City has enacted legislation requiring a dog owner to remove the dog's excrement from the street or be fined for failure to comply.

Accordingly, a number of commercially available devices have been developed and marketed to assist an animal owner in removing his animal's excrement from city street. Such devices include, for example, chemical devices to chemically decompose the fecal matter as well as other hand held or wheeled devices for scraping or shoveling it up into containers.

Such prior art devices present a number of disadvantages including, for example, extreme bulkiness or they require the owner to physically handle the animal's excrement in order to dispose of it.

Against the foregoing background, it is a primary object of the present invention to provide an animal excrement removal device wherein the excrement is drawn into an excrement containing housing by suction generated by the device.

It is another object of the present invention to provide such a device wherein the suction is generated by piston means contained within the device.

It is still another object of the present invention to provide such a device wherein the piston means are cocked or otherwise actuated by mechanically-assisted priming means.

It is yet still another object of the present invention to provide such a device which is readily capable of being operated and carried by an animal owner.

It is still yet another object of the present invention to provide such a device wherein a disposable bag may be included in the excrement containing housing for easy disposal by the owner.

SUMMARY OF THE INVENTION

To the accomplishments of the foregoing objects and advantages, the present invention, in brief summary, comprises an animal excrement removal device which includes an excrement containing housing adapted to receive and retain the excrement; piston means adapted to generate sufficient suction to draw the excrement into the housing; priming means adapted to actuate or cock the piston means; and release means adapted to release the piston from its actuated or cocked position and generate sufficient suction in the housing so as to draw the excrement therein. Baffle means may be provided in the housing to prevent the excrement from being drawn up into the piston means. Alternatively, a disposable bag may be utilized within the housing thus assisting the owner in readily disposing of the excrement. The priming means may be mechanically or electrically assisted and the release means are provided in the form of a trigger which, upon depression thrust is adapted to release the piston means from its actuated or cocked position and generate suction in the housing.

BRIEF DESCRIPTION OF THE DRAWINGS

The foregoing and still other objects and advantages of the present invention will be more apparent from the following detailed explanation of the invention in connection with the accompanying drawings wherein:

FIG. 9 illustrates the manner in which the disposable bag contained in the excrement containing housing may be disposed of;

DETAILED DESCRIPTION OF THE PREFERRED EMBODIMENTS

Figures 1, 10, 11:
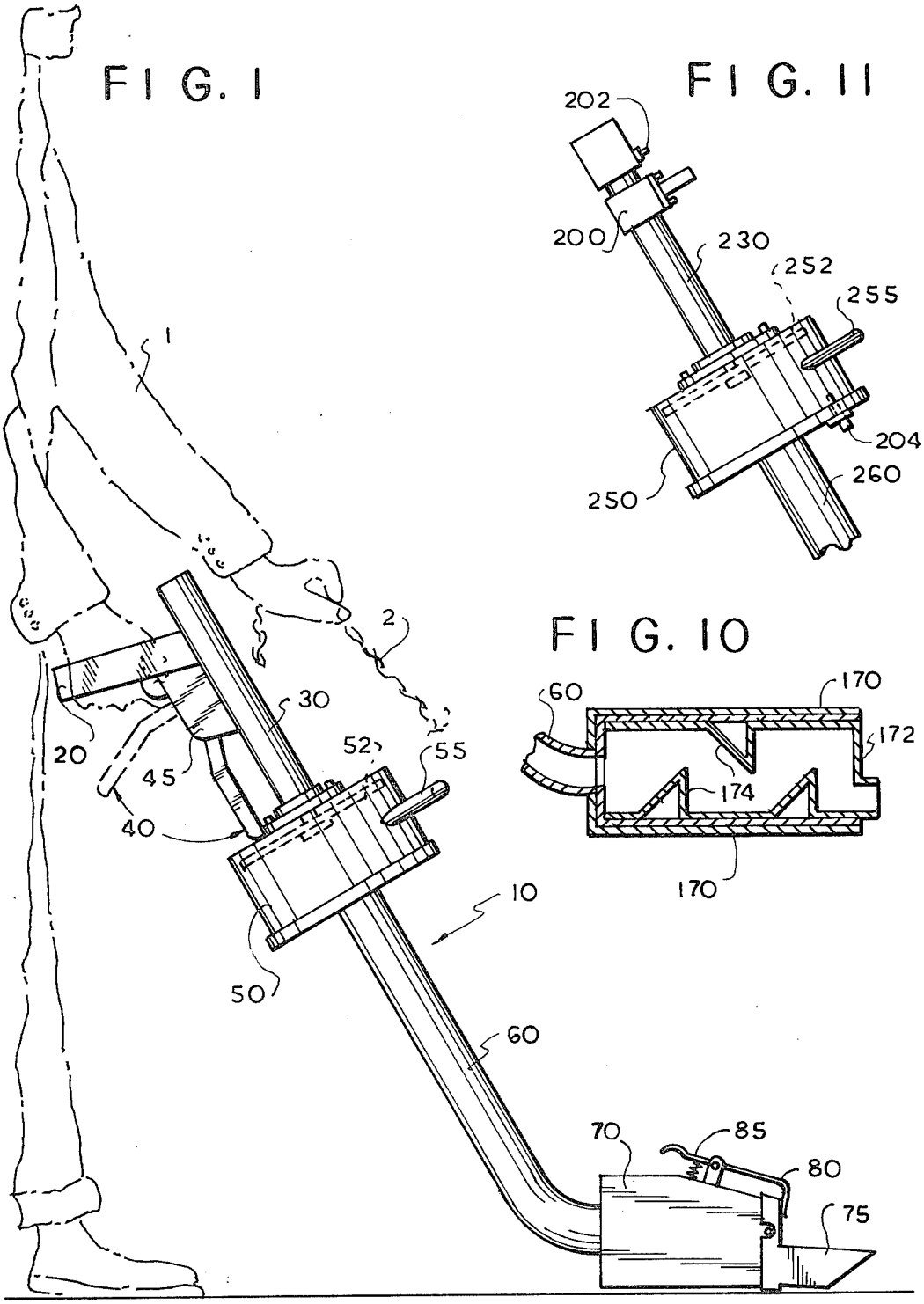
FIG. 1 illustrates, in side view, the manner in which the animal excrement removal device of the present invention may be used by an animal owner.
FIG. 10 is a sectional side view showing an alternative embodiment of the excrement containing housing of the subject invention.
FIG. 11 illustrates an alternative embodiment of the subject device wherein the piston means are actuated or cocked by an electric motor.

Referring now to the drawings and, in particular, to FIG. 1 thereof, there is shown, in side view, an animal owner 1 walking his animal on a leash 2 and holding the excrement containing device of the subject invention identified generally by reference numeral 10. Excrement removal device 10 includes a handle or stock 20 mounted on and extending outwardly from a piston rod housing 30. A priming lever 40, partially covered by guard 45, extends outwardly from piston rod housing 30. Piston rod housing 30 is connected to a piston cylinder housing 50 which includes a movable piston head 52 therein. A handle 55 is provided on the exterior surface of piston cylinder housing 50 for gripping by the animal owner 1.

An excrement containing housing 70 is connected to piston cylinder housing 50 by suction tube 60. Excrement containing housing 70 is open at one end thereof and includes a nozzle 75 at that end which is releasably retained thereon by spring biased latch 80.

FIGS. 2 through 6 illustrate the manner in which piston head 52 upon priming is driven downwardly within piston cylinder housing 50 overcoming a compressive spring force to an actuated or cocked position at which position it is locked. Upon subsequent release, the piston head 52 is forced upwardly within the piston cylinder housing 50 by the compression spring which generates suction and causes the excrement to be drawn up into excrement containing housing 70 through nozzle 75.

Figures 2, 3:
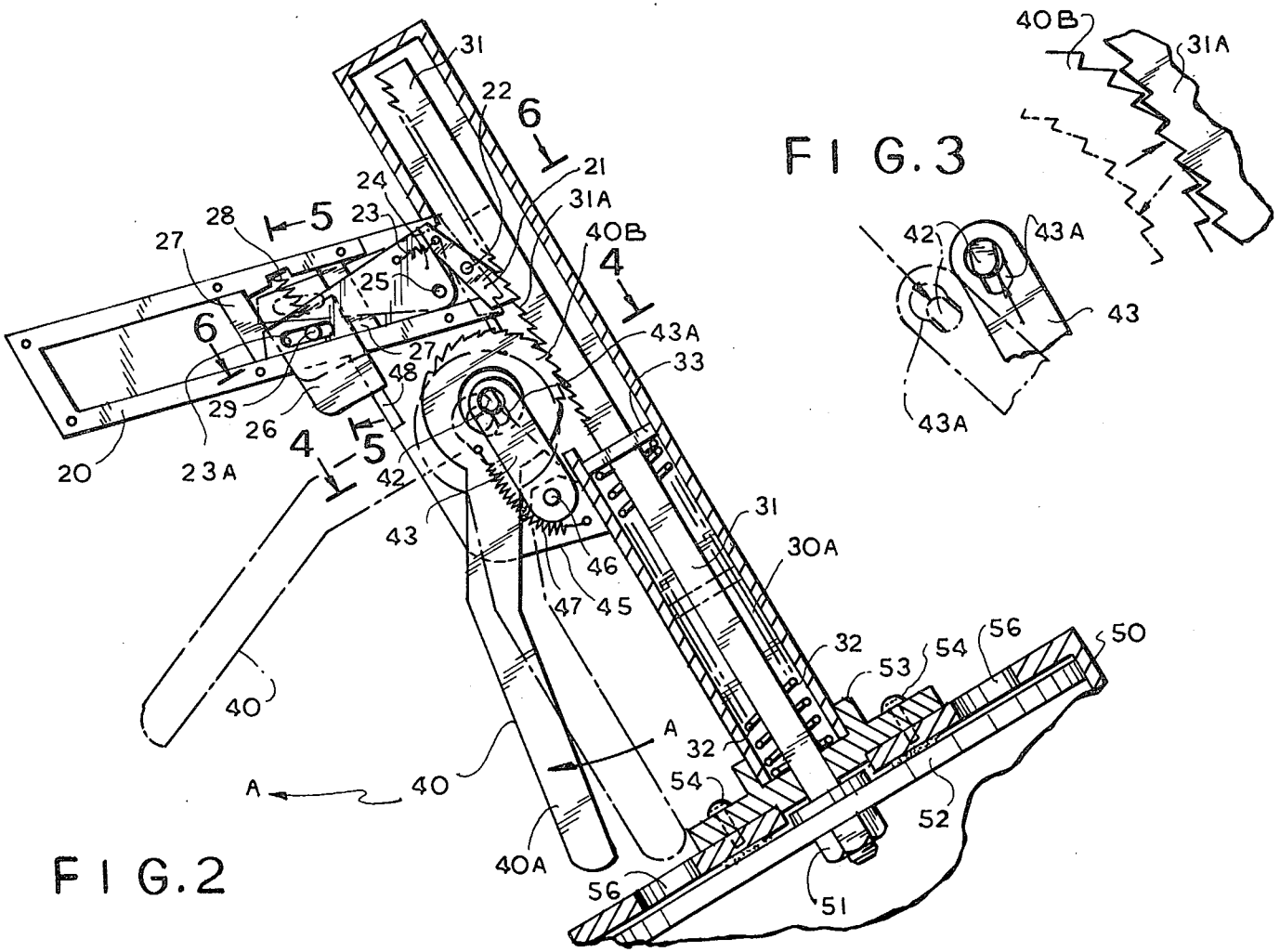
FIG. 2 is a sectional side view of the priming and release means of the device of the subject invention.
FIG. 3 is an enlarged view illustrating the pinion gear of the priming lever and the rack gear of the piston rod and the motion of the priming lever moves during operation.
Figure 6:
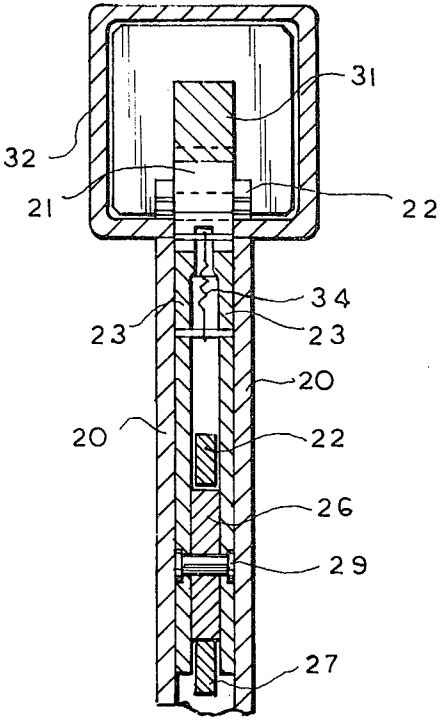
FIG. 6 is a sectional view taken along line 6—6 of FIG. 2.
Figure 5:
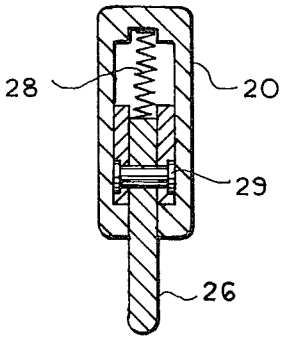
FIG. 5 is a sectional view taken along line 5—5 of FIG. 2.
Figure 4:
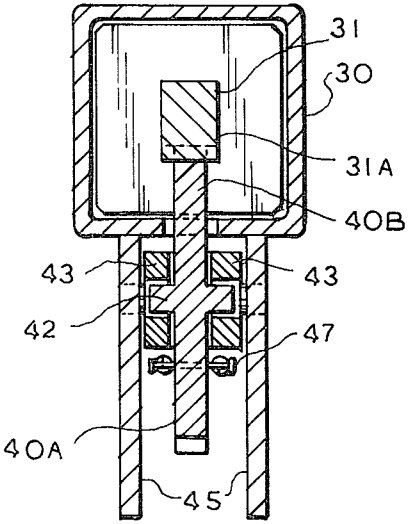
FIG. 4 is a sectional view taken along line 4—4 of FIG. 2.

As shown in detail in FIG. 2, piston head 52, which is mounted in piston cylinder housing 50, is connected to piston rod 31 by retaining nut 51. Piston rod 31 is spring loaded by compression spring 32 positioned about piston rod 31 within spring chamber 30A of piston rod housing 30. Compression spring 32 is retained within chamber 30A between a washer or stop 33 extending outwardly from the piston rod 31 at a point proximately spaced from the ends thereof and guide and centering block 53 which is secured to the upper surface of piston cylinder housing 50 by a plurality of screws or bolts 54. A plurality of vents 56 are provided about the top of piston cylinder housing 50 to permit air to escape from the top of said housing 50 when piston head 52 is drawn in an upward position.

A rack gear 31A is provided along at least one side of piston rod 31.

A priming lever 40 including a handle 40A and pinion gear 40B is provided with pinion gear 40B being adapted to engage rack gear 31A. Pinion gear 40B (and thus priming lever 40) are pivotably mounted about center pivot 42 which is secured by link 43 to guard plate 45. Link 43 is pivotably mounted at its opposite end to guard plate 45 by pivot 46. A keyhole slot 43A is provided in link 43 adapted to receive center pivot 42 which extends through guard plate 45. Tension spring 47 connects pinion gear 40B to guard plate 45 and tends to draw or otherwise force priming handle 40A, after cocking, back to a relaxed position.

It will be appreciated that the function of priming lever 40 is to force piston head 52 down to its lowermost or cocked position within piston cylinder housing 50. This is effected by rotation of pinion wheel gear 40B about pivot 42 as the handle 40A is drawn toward stock 20. As shown in FIG. 2, as the priming lever handle 40A is drawn toward stock 20, pinion gear 40B rotates in a clockwise manner and, as its gears engage the gears of rack gear 31A, it forces piston rod 31 and piston head 52 downwardly in piston cylinder housing 50 until the piston head 52 reaches its lowermost position.

As shown in FIG. 3, priming lever 40 and link 43 are pivotably mounted about center pivot 42. A keyhole 43A is provided at one end of line 43 and is adapted to receive center pivot 42. As shown in FIGS. 2 and 3 when the priming lever is in a non-actuated or non-cocked position, center pivot 42, which is rectangular in shape, is received in the cutout portion of keyhole 43A. As the priming lever 40 is drawn or cocked in the direction of arrow A, center pivot 42 moves out of the cutout portion and pivots within the center portion of keyhole 43A. Priming lever handle 40A becomes fully cocked when it contacts stop plate 48. The priming lever handle 40A, after cocking, is then drawn back into a relaxed position by the action of spring 47. In a relaxed position, link 43 moves the gears of pinions 40B out of engagement with the gears of rack gear 31A.

Piston head 52 after being fully depressed by the action of priming lever 40, is retained in such actuated or cocked position by release lever pawl 21 which engages the gears of rack 31A. Release lever pawl 21 is pivotably mounted about pivot 22 which, in turn, is secured to plate 23. A tension spring 24 is provided between plate 23 and release lever pawl 21. Plate 23 is pivoted about plate pivot 25 and contacts with release lever trigger 26 which is guided between guides 27 on either side of release lever trigger 26. A compression spring 28 is provided between the rear portion of stock or handle 20 and release lever trigger 26 and the force generated by it must be overcome during depression of the trigger 26 by the user. An elongated slot 23A is provided in plate 23 and a pin 29 passes through and is contained within elongated slot 23A.

In actual operation, upon depression of trigger 26 by the user, overcoming the force of compression spring 28, plate 23 is driven toward the back of stock or handle 20 causing release lever pawl 21 to pivot about pivot 22 and become disengaged from rack gear 31*a* of piston rod 31. In such manner, the tension on piston head 52, which had been compressed against the force of compression spring 32 to the lowest portion of the piston cylinder housing 50, is released and it is then rapidly driven upwardly by the force of compression spring 32. Air vents 56 on the upper portion of piston cylinder housing 50 serve to permit the escape of air as piston head 52, after release, is rapidly raised to its upper position. Such force due to the pressure differential created generates suction within piston tube 60 and within excrement containing housing 70 thus drawing any excrement from the pavement through nozzle 75 into the disposable bag 72 contained into the excrement containing housing 70. Excrement is drawn into the disposable bag 72 as a result of the pressure differential created inside the bag and outside the bag caused by the suction generated in the excrement containing housing 70.

Figure 9:
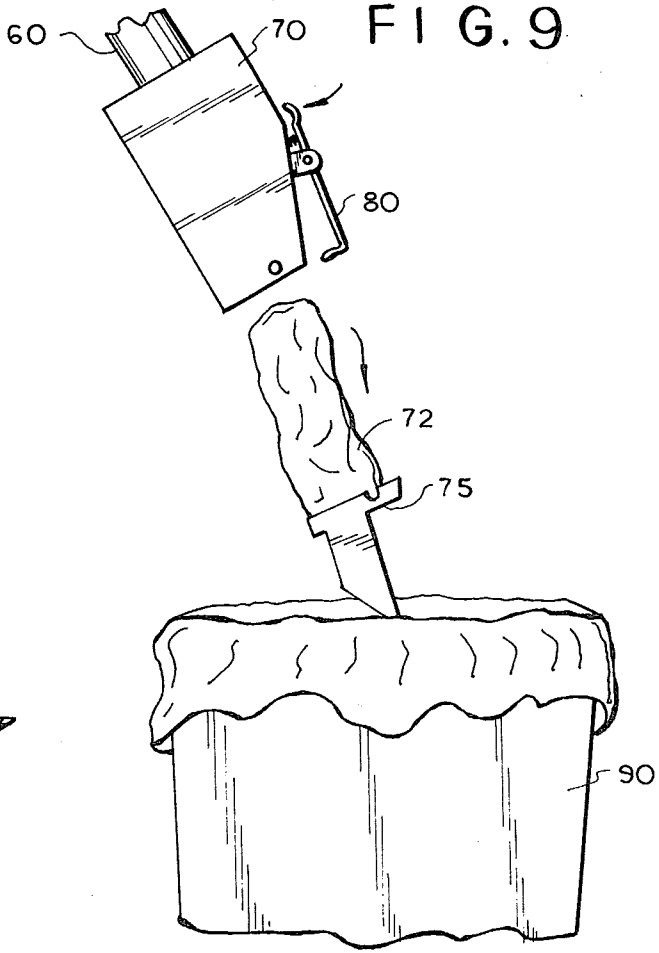
Figure 8:
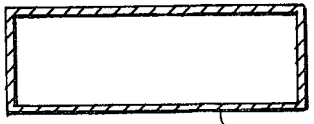
FIG. 8 is a sectional view taken along line 8—8 of FIG. 7.
Figure 7:
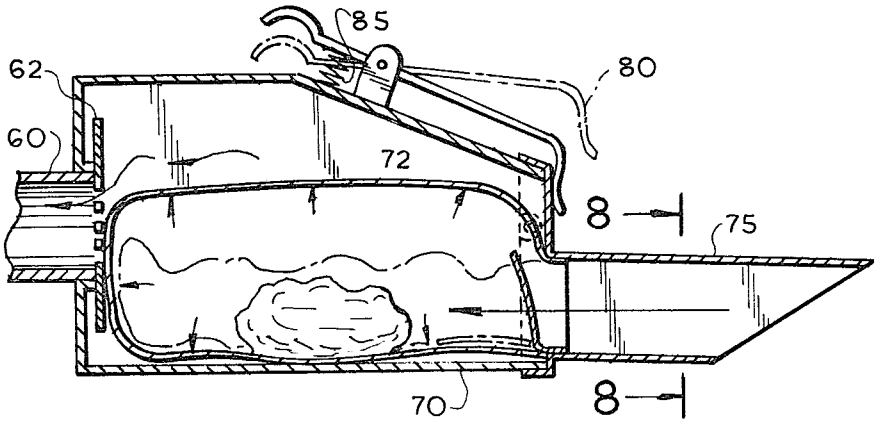
FIG. 7 is a sectional side view of the excrement containing housing of the device of the subject invention.

FIGS. 7, 8 and 9 are illustrative of the manner in which the excrement is drawn into excrement containing housing 70 through nozzle 75 as is shown, for example, in FIG. 7. Excrement containing housing is connected to piston cylinder housing 50 by suction tube 60 at its end opposite nozzle 75. An annular seal 62 is provided about the end of suction tube 60 to ensure a tight seal between suction tube 60 and excrement containing housing 70. Nozzle 75 serves to position the housing 70 relative to the excrement and to draw the excrement within the bag 72.

FIG. 9 illustrates the manner in which the disposable bag 72 containing excrement and the soiled nozzle 75 may be disposed of in an ordinary garbage or trash pail 90. By depression of the handle end of latch 80 overcoming the effect of spring 85, the latch 80 is released thereby permitting the nozzle 75 and excrement containing bag 72 to be discarded. A new nozzle 75 and bag 72 would replace the discarded one and be secured thereto by latch 80.

FIG. 10 is illustrative of an alternative embodiment of the excrement containing housing 70 wherein a permanent excrement containing housing is employed rather than disposable bags. Excrement containing housing 170 includes a baffle insert 172 which contains a plurality of inwardly extending baffles 174 which prevent the excrement, upon suction, to be drawn into suction tube 60.

FIG. 11 illustrates still another embodiment of the present invention wherein a motor 200 is employed for cocking piston head 252 within piston cylinder housing 250. A start button 202 is provided to actuate motor 200 and a limit switch 204 is further provided to cause the motor to shut off upon full depression of piston head 252.

Without further analysis, the foregoing will so fully reveal the gist of the present invention that others can, by applying current knowledge, readily adapt the various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. A portable animal excrement removal device comprising, in combination:

an excrement containing housing adapted to receive and retain excrement;

piston means adapted to generate sufficent suction to draw excrement into said excrement containing housing;

priming means adapted to cock said piston means in a loaded position, said priming means including a priming lever having a handle and pinion gear adapted to engage a rack gear on said piston rod; and release means adapted to release said piston means from its loaded position and generate suction in said excrement containing housing.

2. The device of claim 1 wherein said release means include a trigger connected to a release lever pawl, said pawl, in an actuated position, being adapted to engage said rack gear to retain said piston head in a loaded position and, upon depression of said trigger, being adapted to disengage said pawl from said rack gear and cause said piston head to be released from its loaded position.

3. The device of claim 1 wherein said excrement containing housing includes a disposable bag adapted to receive and retain said excrement.

4. The device of claim 3 wherein said excrement containing housing further includes a nozzle for concentrating suction and means for releasably securing the nozzle to said excrement containing housing.

5. The device of claim 1 wherein said excrement containing housing includes at least one baffle for entraping the excrement within said excrement containing housing.

6. The device of claim 1 wherein said priming means comprises a motor adapted to draw said piston means to a loaded position.

7. A portable, animal excrement removal device comprising in combination:

an excrement containing housing including a nozzle releasably secured to one end of said housing and a disposable bag contained within said housing, said bag adapted to receive and retain excrement drawn by suction through said nozzle;

piston means including a piston rod having a rack gear thereon connected to a piston head contained inside a piston head housing, said piston rod being spring loaded and adapted to generate sufficient suction to draw excrement into the bag inside said excrement containing housing;

priming means adapted to overcome the spring load of said piston rod and draw said piston head to a loaded position, said priming means including a priming lever having a handle and a pinion gear adapted to engage the rack gear of said piston rod to move said piston head to a loaded position; and release means adapted to release said piston head from its loaded position, said release means including a spring loaded trigger interconnected to a release lever pawl, said pawl adapted to engage said rack gear to retain said piston head in a loaded position and, upon depression of said trigger, adapted to disengage from said rack gear causing said spring loaded piston head to be forced upwardly in the piston head housing thereby generating suction within said excrement containing housing causing excrement to be drawn into the bag.

8. The device of claim 7 wherein said piston means are connected to said excrement containing housing by a suction tube.

* * * * *